US007275859B2

(12) United States Patent
Forsey et al.

(10) Patent No.: US 7,275,859 B2
(45) Date of Patent: Oct. 2, 2007

(54) DISPLAY DEVICE FOR WATCH

(75) Inventors: Stephen Edward Methuen Forsey, Le Locle (CH); Robert Greubel, La Neuveville (CH)

(73) Assignee: Vaucher Manufacture Fleurier S.A. (CH)

( * ) Notice: Subject to any disclaimer, the term of this patent is extended or adjusted under 35 U.S.C. 154(b) by 212 days.

(21) Appl. No.: 10/528,281

(22) PCT Filed: Apr. 22, 2003

(86) PCT No.: PCT/IB03/01610

§ 371 (c)(1),
(2), (4) Date: Mar. 16, 2005

(87) PCT Pub. No.: WO2004/031871

PCT Pub. Date: Apr. 15, 2004

(65) Prior Publication Data

US 2005/0259520 A1 Nov. 24, 2005

(30) Foreign Application Priority Data

Oct. 7, 2002 (EP) ..... 02022505

(51) Int. Cl.
*G04B 27/04* (2006.01)
*G04F 10/00* (2006.01)

(52) U.S. Cl. ..... 368/191; 368/110; 368/113

(58) Field of Classification Search ..... 368/101–113, 368/185, 190–199
See application file for complete search history.

(56) References Cited

U.S. PATENT DOCUMENTS

| | | | | |
|---|---|---|---|---|
| 3,903,686 | A * | 9/1975 | Burki | 368/106 |
| 4,259,737 | A * | 3/1981 | Berney | 368/66 |
| 4,459,031 | A * | 7/1984 | Perucchi | 368/69 |
| 4,470,707 | A * | 9/1984 | Chambon et al. | 368/74 |
| 5,113,382 | A * | 5/1992 | Bron | 368/106 |
| 5,500,835 | A * | 3/1996 | Born | 368/11 |
| 5,793,708 | A * | 8/1998 | Schmidt et al. | 368/106 |
| 6,406,176 | B1 * | 6/2002 | Takahashi et al. | 368/101 |

FOREIGN PATENT DOCUMENTS

| | | |
|---|---|---|
| CH | 1473 | 10/1889 |
| CH | 689 028 | 7/1998 |
| GB | 707768 | 4/1954 |

* cited by examiner

*Primary Examiner*—P. Austin Bradley
*Assistant Examiner*—Thanh S. Phan
(74) *Attorney, Agent, or Firm*—McGlew and Tuttle P.C.

(57) ABSTRACT

The invention concerns a display device for a watch movement comprising: a frame (110), an assembly of wheels pivotably mounted on the frame and wherein the angular position of a first (116) and a second (120) among them is based on the state of an information to be displayed, and a display member (126) mobile about an axis (A-A), and designed to enable data associated with the first (116) or the second (120) wheel to be displayed by the same display member (126).

16 Claims, 11 Drawing Sheets

30
43
29
391d
34d
34e
36
40a
20
16
A
38c
32c
38a
38
38d
34b
52
38b
34
34c
503
393a
392a
392
42c
42a
391
42b
44
41
391e
32
32d
A
32b
32a
34a
391a
391c
391b
39
393b
393c
30

DISPLAY DEVICE FOR WATCH

BACKGROUND OF THE INVENTION

The present invention relates to a display device for a watch of the type comprising a movement provided with a frame and a display member that is mobile in rotation about an axis.

In such watches, the display generally occurs by means of hands mounted on a mobile of the movement, with one hand per function displayed. As a result, for watches comprising numerous functions, there is a large number of hands and this tends to overload the dial. It is an object of the present invention to simplify the display while indicating at least two pieces of information with the same member.

SUMMARY OF THE INVENTION

According to the invention, the display device includes:

a display mobile pivotably mounted on the frame about said axis and arranged for carrying said member, first and second information wheels, each of whose angular position is a function of the state of the information with which it is associated, first and second connecting members for connecting respectively the first and second information wheel to the display mobile and positioning it such that said display member occupies a position corresponding to the state of said function, and a manual control member cooperating with the connecting members so that either one or the other forms the connection between the information wheel with which it is associated and the display mobile.

Thus, via the control member, the user can control the display of one piece of information or the other, one or other of the connecting members kinematically connecting one of the information wheels to the display mobile, such that the position of the display mobile corresponds to the angular position of the information wheel concerned.

Among the solutions that can be envisaged, it is advantageous for the first information wheel to be coaxial with the display mobile and for the first connecting member to comprise a cam and a hammer provided with an elastic member for holding the hammer pressed against the cam, one being mounted on the display mobile, the other on the first information wheel. Consequently, while the control member is not being activated, the display mobile is driven in rotation in synchronism with the first information wheel.

Other advantages and features of the invention will appear from the following description, given with reference to the annexed drawing.

DESCRIPTION OF THE PREFERRED EMBODIMENT

Figure 1:
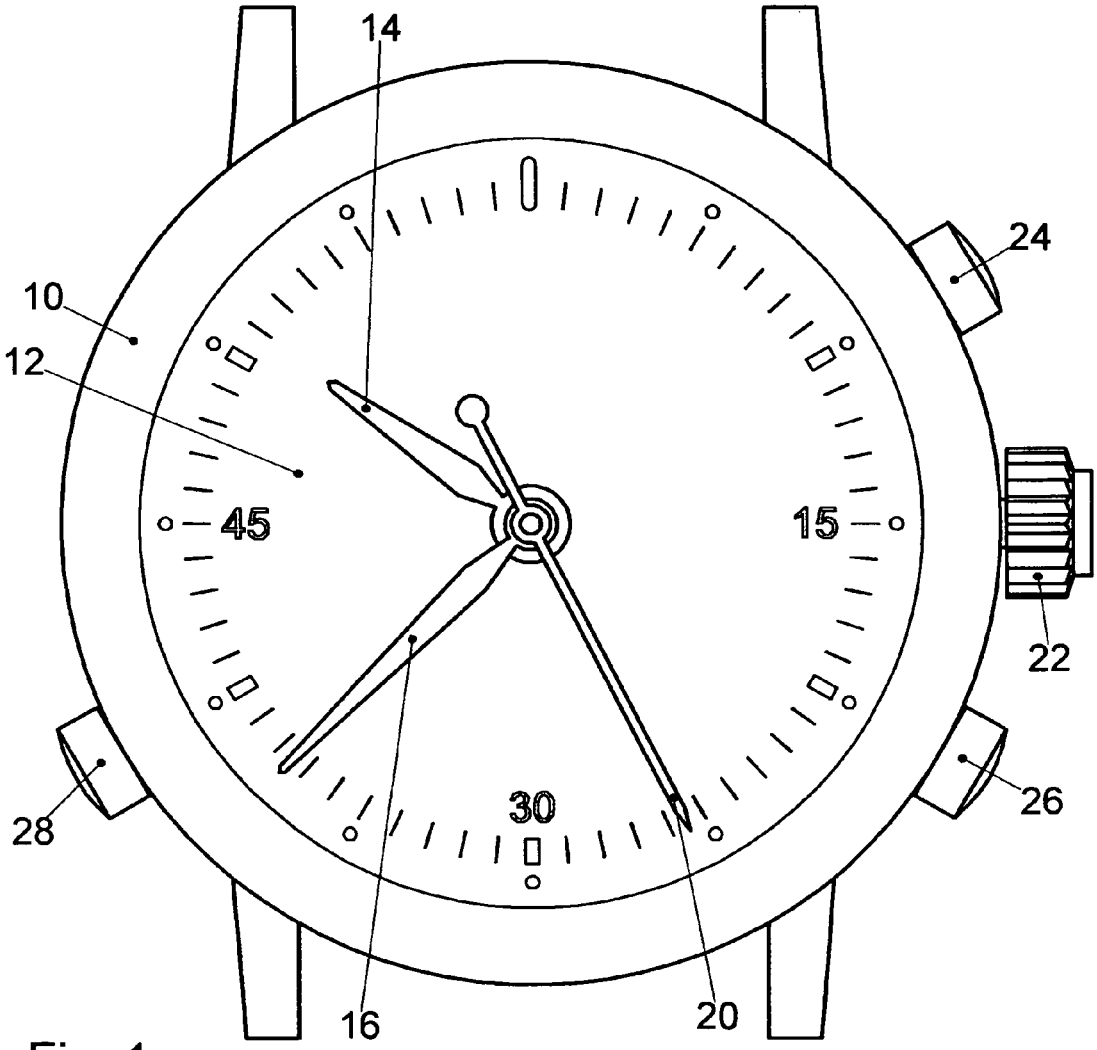
FIG. 1 shows a chronograph type watch fitted with a display device according to the invention.

The watch shown in FIG. 1 is of the chronograph type. It comprises, in a conventional manner, a case 10 acting as housing for a movement, which carries a dial 12, a current time hour hand 14, a current time and measured time minute hand 16 and measured time second hand 20.

The current time display is corrected by means of a time setting crown 22, connected to members of the movement by a time setting stem that is not visible in the drawing.

The timing functions are performed by three push-buttons 24, 26 and 28 respectively arranged at two o'clock, four o'clock and eight o'clock. Push-button 24 controls the starting and stopping of a measured time measurement, whereas push-button 26 resets hands 16 and 20 when a measured time measurement has been interrupted. Finally, push-button 28 is for making the chronograph mechanism pass from a first state, in which it is locked, into a second state in which it is unlocked.

When the chronograph mechanism is locked, hand 16 displays the minutes of the current time, whereas, when it is unlocked, it indicates the measured time. In the locked state, push-buttons 24 and 26 are inactive.

Figure 4A:
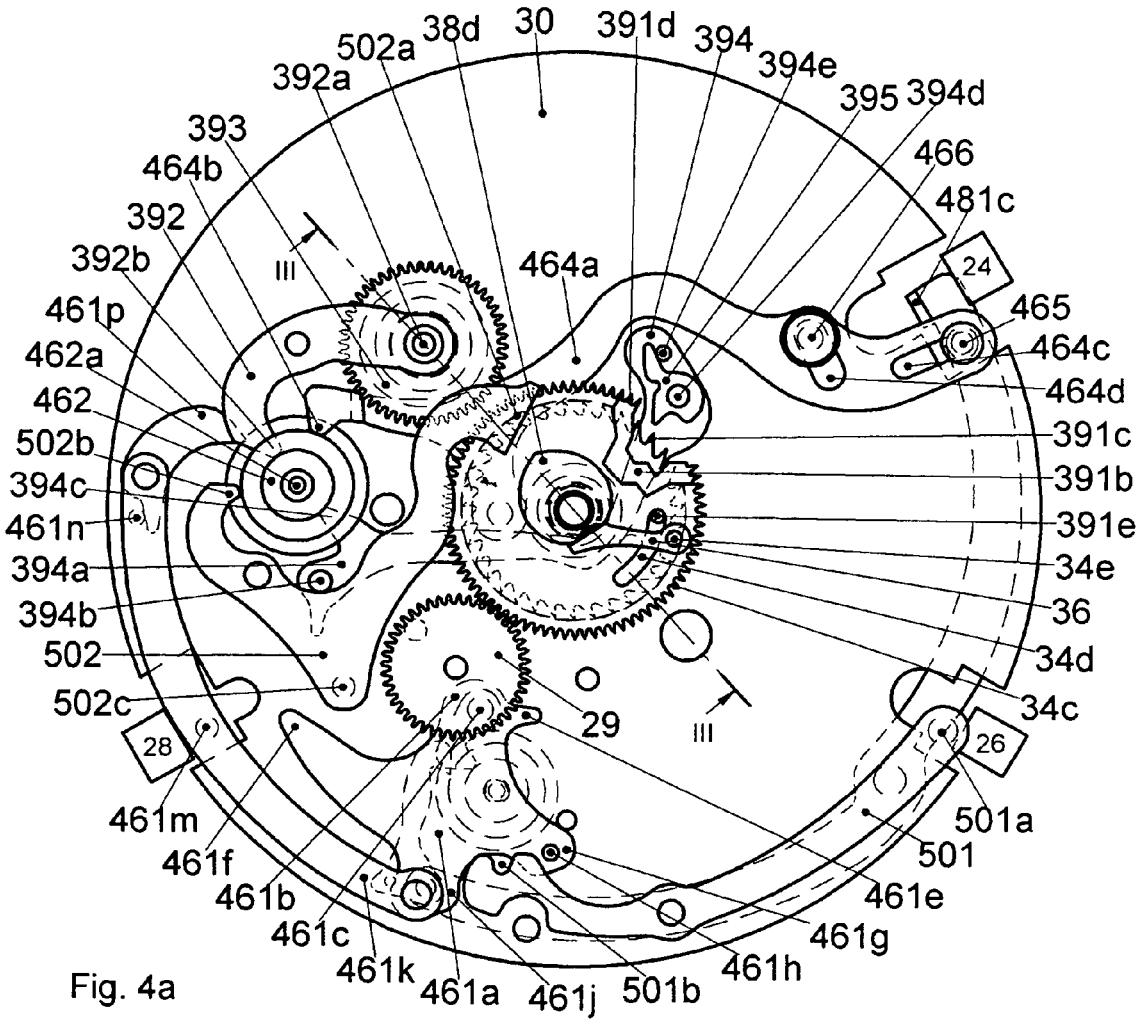
FIGS. 4*a* to 4*d* show the dial side of the movement of FIG. 3, in different states corresponding to the steps defined in the diagram of FIG. 2.

This mechanism forms part of a movement which comprises, in a conventional manner that is not visible in the drawing, an energy source, such as a barrel, a time base such as a sprung balance, a going train, of which only one mobile 29 is visible in FIG. 4*a*, and an escapement connecting the going train to the balance in order to maintain the latter, as well as time setting and chronograph mechanisms. The various components of the movement are disposed on a frame 30, formed of a plate and bridges, which assures the relative positioning of the various mobile parts.

Figure 2:
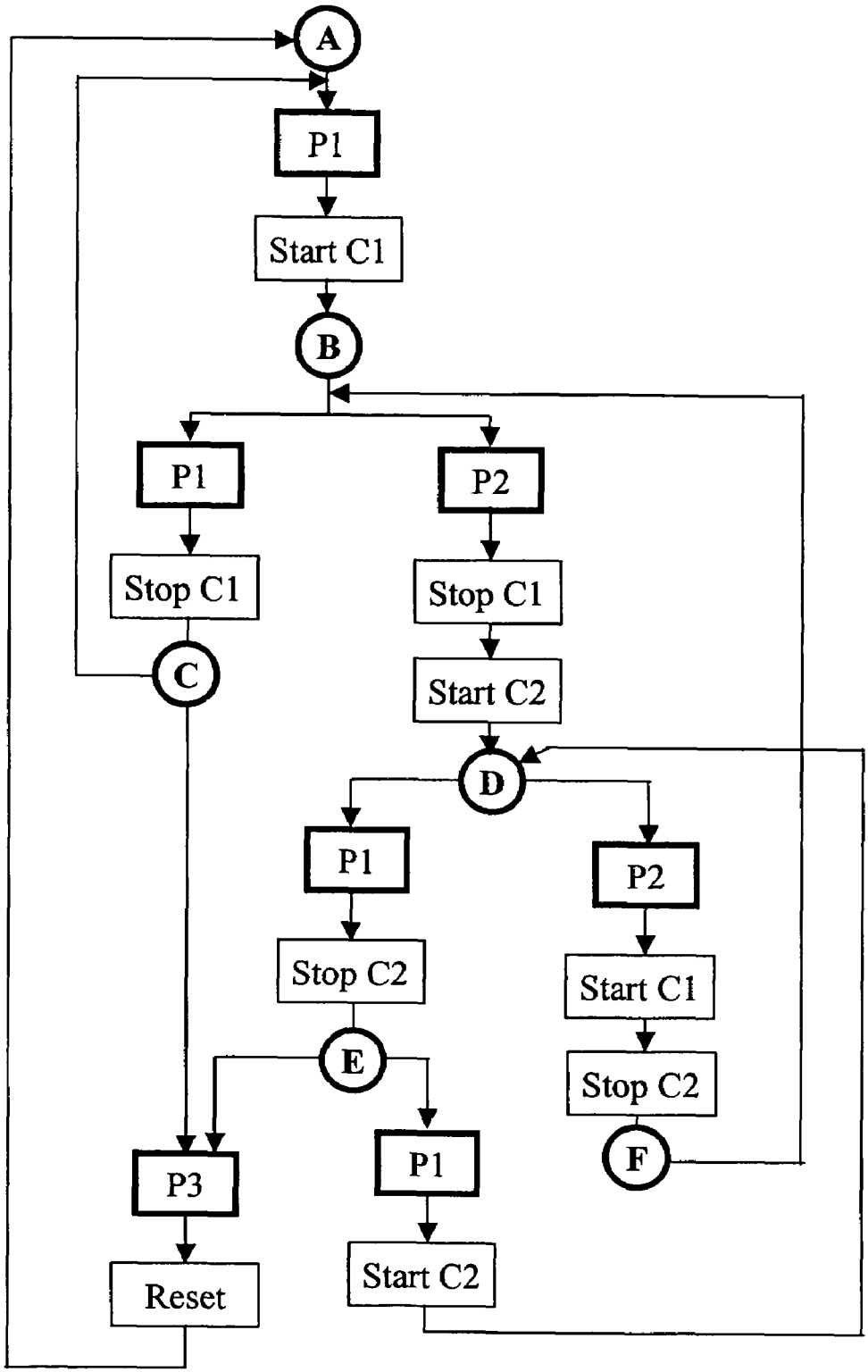
FIG. 2 is a logic operating diagram of the movement according to the invention.

FIG. 2 illustrates the effect of the various push-buttons depending upon the states of the chronograph mechanism, which are identified by a capital letter surrounded by a circle. In this Figure, an application of pressure onto push-buttons 24, 26 and 28, respectively corresponds to the indications P1, P2 and P3.

Figure 4B:
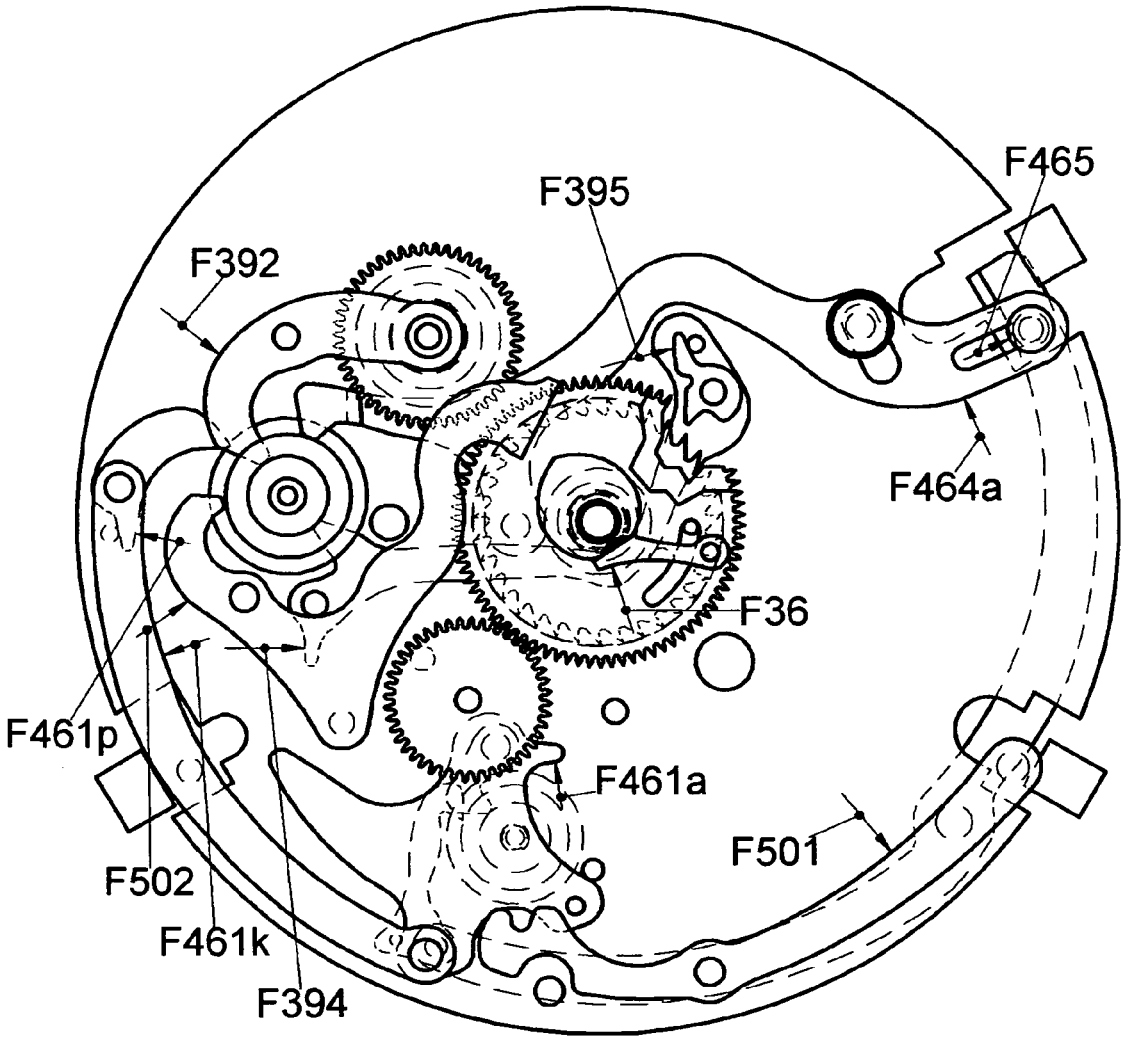

In the initial state, identified by A and corresponding to the situation illustrated by FIG. 4*a* and 4*b*, the chronograph mechanism is locked. The chronograph second hand 20 is at midday and minute hand 16 displays the current time, push-buttons 24 and 26 being inactive.

Figure 4C:
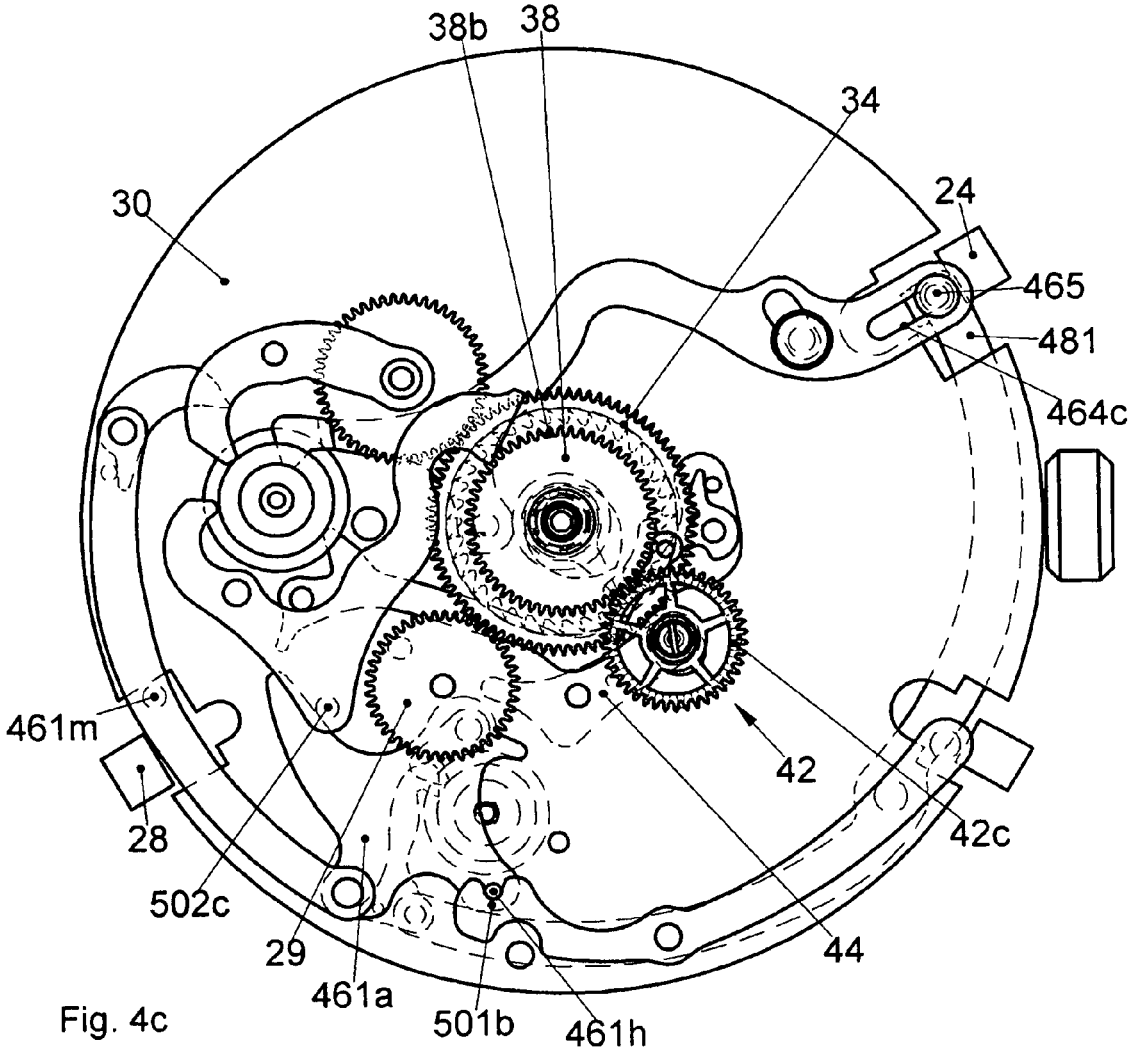

An application of pressure P3 causes the chronograph mechanism to unlock. As a result, minute hand 16 is aligned at twelve o'clock, thus being superposed onto the measured time second hand 20. This state, shown in FIG. 4*c*, is identified by the letter B. Minute hand 16 thus displays the measured time minutes, equal to zero at the start of the measurement.

In this state, push-buttons 24 (P1) and 28 (P3) are active. An application of pressure P1 has the effect of starting the counting of a measured time, the measured time second hand 20 starting to rotate and, more slowly, the minute hand 16. This state, shown in FIG. 4*d* and identified by the letter C, brings the display to the situation illustrated in FIG. 1.

In state B, an application of pressure P3 returns the chronograph mechanism to its initial state A.

In state C, only push-button 24 is active. An application of pressure P1 has the effect of stopping counting of the measured time. Hands 16 and 20 thus stop in the position corresponding to the measured time, which corresponds to state D, which only differs from state B in that the hands are not at zero.

Another application of pressure P1 then has the effect of restarting counting, the mechanism thus returning to state C, whereas an application of pressure P2 returns hands 16 and 20 to midday, which corresponds to state B.

Figure 4D:
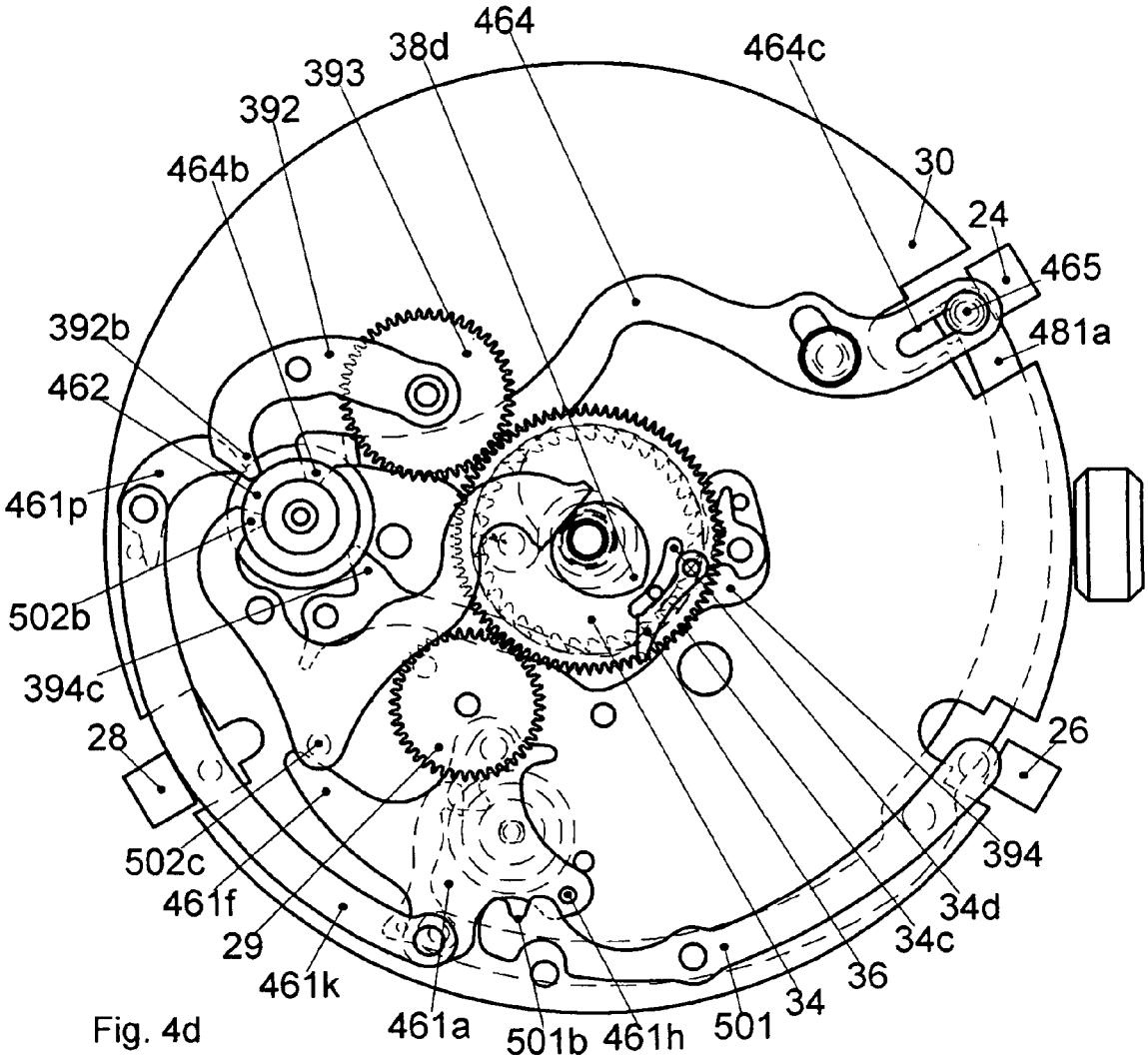
Figure 5:
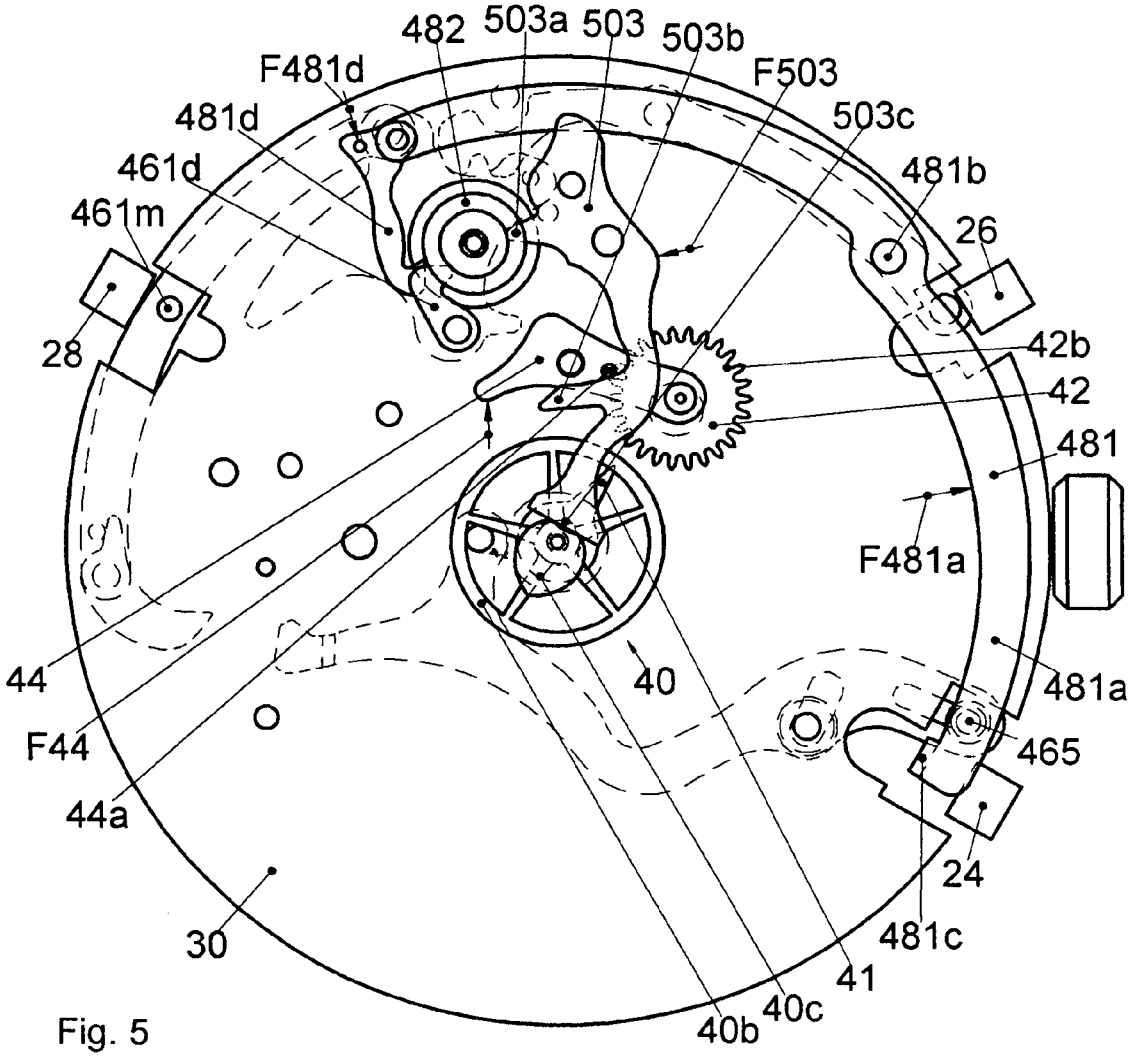
FIG. 5 illustrates the back cover side of the movement of FIG. 3, when the chronograph function is locked.

In FIGS. 4 and 5 and in order to avoid overloading the drawings, the springs have only been shown schematically, by means of an arrow showing the force that they generate, associated with a reference Fi, "i" being equal to the reference of the part on which the spring is acting. They are essentially visible in FIG. 4*b*.

More precisely, FIGS. 4*a* and 4*b* show the mechanism in its rest position, corresponding to state A, and FIGS. 4*c* and 4*d* in positions corresponding respectively to states B and C of FIG. 2. Among FIGS. 4*a* to 4*d*, which show the dial side of the movement, some parts have been removed or partially torn away from these Figures, in order for the subjacent parts to be seen more clearly.

In the description relating to the movement described with reference to FIGS. 3 to 5, the terms "wheel" or "mobile" (wheel) are used to differentiate between the components of the chronograph train and going train respectively.

The movement described hereinafter with reference to FIGS. 3 to 5 comprises, in a conventional manner that is not visible in the drawing, an energy source such as a barrel, a time base such as a sprung balance, a going train of which only one mobile 29 is visible in FIGS. 3 and 4, and an escapement connecting the going train to the balance in order to maintain the latter, as well as time setting and chronograph mechanisms. The various components of the movement are disposed on a frame 30, formed of a plate and bridges, which assures the relative positioning of the various mobile parts of the movement.

Figure 3:
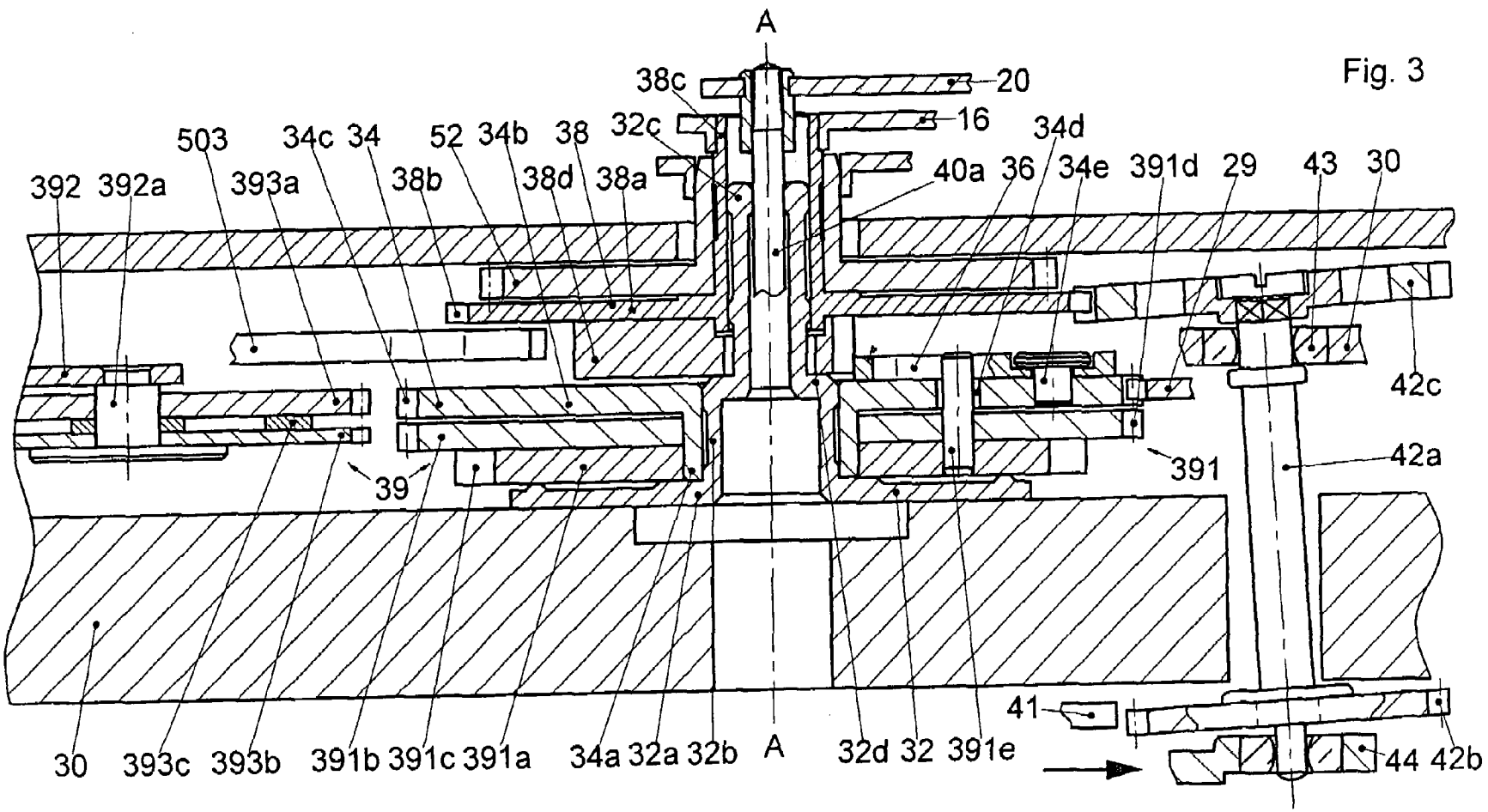
FIG. 3 is a cross-sectional view of a movement fitted with a display device according to a first embodiment of the invention.

FIG. 3 shows the central part of the movement, seen in cross-section along the line III-III of FIG. 4*a*, with an axis A-A corresponding to the axis about which hands 14, 16 and 20 pivot. Frame 30 carries, rigidly secured to its dial side face, a tube 32 comprising a seat 32*a* secured to frame 30 and two cylindrical portions 32*b* and 32*c*, whose axis merges with axis A-A, and arranged one after the other, connected by a shoulder 32*d* and designed to act as a fixed arbour for the pivoting of the mobiles and wheels, as will be explained hereinafter.

A current time minute mobile 34 is pivotably mounted on tube 32. It is provided with a pipe 34*a* engaged on cylindrical portion 32*b* of tube 32 and a plate 34*b* including a toothing 34*c* at its periphery. Pipe 34*a*, plate 34*b* and toothing 34*c* are made in a single piece.

Mobile 34 meshes permanently, via its toothing 34*c*, with mobile 29 of the going train, in a gear ratio selected such that it completes one revolution per hour of current time.

Plate 34*b* is provided with:

- a cut out part 34*d* in the form of an annular portion covering an angle of approximately 50°, the function of which will be specified hereinafter,
- a stud 34*e*, on which a connecting hammer is pivotably mounted, and
- a spring tending to return hammer 36 to the centre and schematically represented by arrow F36 (FIG. 4*b*).

A minute hand wheel 38 is arranged to be free in rotation on cylindrical portion 32*c* of tube 32. This wheel 38 is only visible, in plan, in FIG. 4*c*. It comprises a plate 38*a* provided, at its periphery, with a toothing 38*b*, and a pipe 38*c* engaged on tube 32 and extending upwards sufficiently for its free end to be released and to allow minute hand 16 to be secured. The latter displays both the current time and the measured time, as will be explained hereinafter. Pipe 38*c* extends underneath plate 38*a*. A cam 38*d*, generally called a heart-piece, and more particularly visible in plan in FIGS. 4*a*, 4*b* and 4*d*, is secured by being driven in or welded thereto. Its lower face abuts against shoulder 32*d*. This cam 38*d* is arranged such that it can cooperate with hammer 36, as will be explained hereinafter.

The movement comprises an isolating device whose components' reference starts with 39 and which includes an isolation mobile 391 mounted on pipe 34*a*, a lever 392, a retaining wheel 393 pivotably mounted on lever 392, an isolation lever 394 and a pawl or click 395 mounted on lever 394 (FIG. 4*a*).

Mobile 391 comprises two superposed plates 391*a* and 391*b*, rigidly connected to each other and provided at their periphery with toothings respectively referenced 391*c* and 391*d*, and a pin 391*e* secured in plate 391*a* (FIG. 3). This lower plate is provided with wolf teeth, clearly visible in FIG. 4*a*, whereas toothing 391*d*, of upper plate 391*b* comprises the same number of teeth and has the same profile and same diameter as toothing 34*c*. Pin 391*e* is engaged in cut out part 34*d* and extends as far as hammer 36.

Retaining lever 392 is mounted on frame 30, pivoting in its median part. It carries, at one of its ends, wheel 393 which can rotate on a stud 392*a* driven into lever 392, whereas the other end forms a nose 393*b* which, as will be explained hereinafter is for controlling the movement of lever 392. A spring F392 tends to apply nose 392*b* against a support surface.

As shown schematically in FIG. 3, wheel 393 is formed of two plates 393*a* and 393*b*, connected to each other by a click 393*c* and respectively capable of being meshed with toothings 34*c* and 391*d*. Click 393*c* is arranged such that, when mobile 34 is rotating in the clockwise direction, the click is locked, such that plate 393*b* drives mobile 391 in rotation. If, conversely, it is the latter that is being rotated in the clockwise direction, only plate 393*b* is driven, click 393*c* performing its uncoupling function.

Lever 394 comprises (FIG. 4*a*):

- a body 394*a* pivotably mounted on frame 30, by the engagement of a hole 394*b* made at one of the ends of body 394*a* of the lever in an unreferenced stud, secured to frame 30,
- a nose 394*c*, located in proximity to hole 394*b* for controlling the movement of lever 394,
- a stud 394*d* driven into the body at the opposite end to that provided with hole 394*b*, on which pawl 395 pivots, and
- a pin 394*e*, forming a stop member and limiting the movement of pawl 395.

Lever 394 is positioned by nose 394*c* abutting against a support surface, via the action of a spring F394. A spring F395 tends to hold pawl 395 abutting against pin 394*e*.

Isolation mobile 391 can be moved by an angle of approximately 45° with respect to mobile 34, by the engagement of pawl 395 in toothing 391*c*. During this movement, pin 391*e*, moving freely in cut out part 34*d*, raises hammer 36 whose free end is brought back towards the exterior.

When the chronograph mechanism is locked, by means that will be explained hereinafter, hammer 36, positioned by spring F36, which tends to apply it against cam 38*d*, performs the function of connecting member between mobile 34 and wheel 38, which are thus secured to each other in rotation. This thus means that minute hand 16, carried by pipe 38*c* of wheel 38, displays the minutes of the current time.

In order to count the measured time, the movement shown in the drawing comprises a chronograph second wheel 40, pivotably mounted in tube 32, visible in FIG. 5 and partially in FIG. 3, and a sliding gear 42 (FIGS. 3, 4*c* and 5). Wheel 40 comprises an arbour 40*a* pivotably mounted in tube 32 and in frame 30, a plate 40*b* driven onto arbour 40*a* and provided with a toothing, a cam 40*c*, also driven onto arbour 40*a*, and a drive finger 41.

The chronograph mechanism further includes a coupling mechanism, not visible in the drawing, provided with a wheel which, when the chronograph mechanism is in state C, kinematically connects wheel 40 to the going train, such that it is driven in rotation, at a rate of one revolution per minute. Such a coupling mechanism is well known to those skilled in the art.

Slide gear 42 comprises an arbour 42*a* (FIG. 3) rotatably mounted in a jewel 43, with an olive jewel-hole, driven onto a bridge of frame 30 and on a lever 44, itself pivoting on frame 30 and which will be described in more detail hereinafter. It further comprises two wheels 42*b* and 42*c*, respectively for cooperating with finger 41 and wheel 38. Depending upon the position that lever 44 occupies, wheel 42*b* is either in the space swept by finger 41 or not. Moreover, wheel 42*c* is permanently meshed with toothing 38*b*. Lever 44 tends to move in the direction of the centre of the movement via the effect of a spring F44 (FIG. 5).

When the chronograph mechanism is in one of states B, C or D, hammer 36 is raised by pin 391*e*, such that it is no longer abutting against cam 38*d*. Mobile 34 and wheel 38 are thus no longer secured in rotation. Moreover, when the mechanism is in state C, arbour 42*a* is arranged parallel to the axis A-A and its wheel 42*b* can be driven in rotation by finger 41, by one step for each revolution of wheel 40. In other words, slide gear 42 performs the function of a connecting member between measured time second wheel 40 and wheel 38, so that the latter displays the measured time minutes when the mechanism is in state C or D.

The connecting members formed by hammer 36, spring F36 and cam 38*d* on the one hand, and slide gear 42 on the other hand, perform together the function of switching means.

Since current time minute mobile 34 is permanently rotating, driven by the going train, isolation mobile 391 has to rotate with it, otherwise hammer 36 could not be controlled. Therefore, retaining wheel 393 is made to mesh with toothings 34*c* of mobile 34 and 391*d* of isolation mobile 391, the two plates 393*a* and 393*b* being secured to each other in rotation by click 393*c*.

In order to perform the functions as defined with reference to FIG. 2, the chronograph mechanism shown in FIGS. 4 and 5 comprises, in addition to the gear trains and the isolation device described hereinbefore:

- a switch for enabling or disabling the timing function, and whose constituent parts are defined by references starting with 46,
- a control device, controlling the starting and stopping of a measurement, and whose constituent parts are defined by references starting with 48, and
- a reset device, for reinitialising the measured time counters, and whose constituent parts are defined by references starting with 50.

It should be noted that these devices interact and that some parts are arbitrarily defined as forming part of one device rather than another.

Switch 46 is controlled by push-button 28. It allows minute hand 16 to be returned to zero, and push-button 24 to be made active. It comprises, for this purpose (FIG. 4*a*):

- a switching member 461, comprising:
  - a bird-shaped body 461*a*, with a head 461*b* provided with a hole 461*c* in which there is engaged a stem passing right through frame 30 and carrying a finger 461*d* visible in FIG. 5, a beak 461*e*, two wings 461*f* and 461*g*, wing 461*g* being provided with a pin 461*h*, and a tail 461*j*, the head being disposed on the centre side of the movement and tail 461*j* at the periphery, in proximity to 7 o'clock,
  - a lever 461*k* pivotably mounted on tail 461*j* and extending over the periphery of the movement from 7 to 9 o'clock, provided with a pin 461*m* disposed so that it is or is not located on the path travelled by push-button 28, when it is activated depending upon the position occupied by lever 461*k*, and a stop member 461*n* arranged at its free end,
  - a pawl 461*p* pivotably mounted on lever 461*k* and limited in its movement by stop member 461*n*,
- a switching cam, for example a column wheel 462, shown schematically, controlled in rotation by pawl 461*p*, rotating on frame 30 at 462*a*, and cooperating with noses 392*b* of lever 392 and 394*c* of lever 394,
- an interlocking lever 464, comprising a body of elongated shape 464*a*, pivotably mounted on frame 30 in its median part, and one of whose ends is provided with a nose 464*b* arranged for cooperating with the columns of wheel 462, whereas the other end comprises a first oblong hole 464*c* in which a stud 465 is mounted so as to slide, for cooperating with control device 48, and a second oblong hole 464*d*, in which a pin 466 with a head is housed, itself secured to frame 30, for positioning the lever in the plane of the movement.

The constituent parts of switch 46 are positioned by springs shown schematically in FIG. 4*b* and more particularly:

- body 461*a* by spring F461*a*,
- lever 461*k* by spring F461*k* which tends to return it when pressure has been applied to push-button 28,
- pawl 461*p* by spring F461*p* which holds it pressed against pin 461*n*,
- body 464*a* by spring F464*a*, which tends to apply nose 464*b* against wheel 462, and
- stud 465 by spring F465, which tends to press it on the external side of oblong hole 464*c*.

Control device 48 is more particularly visible in FIG. 5. It comprises:

- a control lever 481 comprising:
  - a body 481*a* disposed at the periphery of the movement from 2 to 7 o'clock, which pivots at 481*b* on frame 30 slightly below 4 o'clock, and which is provided, at one of its ends, with a bent portion 481*c* extending into the thickness of stud 465, and
  - a pawl 481*d*, pivotably mounted on the other end of body 481*a*, whose function will be specified hereinafter,
- a cam 482, for example of the column wheel type, driven by pawl 481*d*, which controls the coupling mechanism of the chronograph, not shown in the drawing, and positions switching member 461 via its finger 461*d*.

The constituent parts of control device 48 are positioned by springs and more particularly:

- body 481*a*, by spring F481*a* which tends to return it when pressure has been applied to push-button 24, and pawl 481*d*, by spring F481*d*, which applies it against cam 482.

Reset device 50 comprises:

a reset lever 501 (FIG. 4*a*) arranged and pivotably mounted at the periphery of frame 30 and extending from 4 o'clock to 6 o'clock, provided at its end in proximity to 4 o'clock with a pin 501*a* for cooperating with push-button 26, and at its other end with a groove 501*b* for cooperating with pin 461*h*, a hammer 502 for resetting the minutes to zero arranged in proximity to column wheel 462 and extending as far as the central part of the movement to cooperate with cam 38*d* via a support surface 502*a* provided with:

a nose 502*b* which cooperates with the columns of wheel 462, and a pin 502*c* for cooperating with wing 461*f*, and a hammer 503 for resetting the seconds to zero (FIG. 5) pivotably mounted on the opposite face of frame 30 in proximity to cam 482, provided with:

a nose 503*a* cooperating with cam 482, a retaining finger 503*b* cooperating with lever 44 via a pin 44*a* comprised in the latter, and a support surface 503*c* for returning the second hand to zero by abutting against cam 40*c*.

The constituent parts of reset device 50 are positioned by springs and more particularly:

lever 501 by spring F501, which tends to return it after pressure has been applied on push-button 26, hammer 502 by spring F502, which tends to apply support surface 502*a* against cam 38*d*, and hammer 503 by spring F503, which tends to apply it against cam 40*c*.

The movement further comprises a current time hour mobile 52, pivotably mounted on pipe 38*c* of minute hand wheel 38. Mobile 52 carries current time hour hand 14. It is kinematically connected to mobile 34 by a motion work, which divides the movement by a factor of 12. This motion work has not been shown to avoid overloading the drawing.

When the chronograph mechanism is at rest, namely in state A defined with reference to FIG. 2, its constituent parts are in the position shown in FIGS. 4*a*, 4*b* and 5. More particularly, nose 392*b* of retaining lever 392 is between two columns of column wheel 462 via the effect of spring F392, such that retaining wheel 393 is not meshed with toothings 34*c* and 391*d*. Nose 394*c* of lever 394 is also between two columns via the effect of spring F394, so that pawl 395 is withdrawn from toothing 391*c*. Thus, hammer 36, via the action of spring F36 is abutting against cam 38*d*. Wheel 38 of the minute hand is rotating, consequently, in synchronism with current time minute mobile 34.

The interlocking lever 464 is abutting, via its nose 464*b* and via the effect of spring F464*a*, against a column of wheel 462, such that stud 465 is not inserted between push-button 24 and bent portion 481*c*, which disables push-button 24. Moreover, an action on push-button 26 causes lever 501 to pivot, but without it acting on any of the other parts.

An application of pressure on push-button 28 activates pin 461*m*, which drives with it lever 461*k*, which causes the chronograph mechanism to switch. More precisely, the tipping of lever 461*k* drives pawl 461*p*, which rotates column wheel 462 and generates the following movements, which occur practically simultaneously or in the following order:

nose 392*b* of retaining lever 393 is raised by a column, which causes wheel 393 to mesh with toothings 34*c* and 391*d;* nose 394*c* of lever 394 is raised, such that pawl 395 meshes with toothing 391*c*, driving in rotation, clockwise, mobile 391 and the single plate 393*b*, plate 393*a*, meshed with mobile 34, being disconnected, because of click 393*c;* during the relative movement of mobile 391 with reference to mobile 34, pin 391*e* raises hammer 36, such that cam 38*d* of wheel 38 is no longer maintained in phase with mobile 34;

nose 502*b* of hammer 502 falls, via the effect of spring F502, between two columns of wheel 462, support surface 502*a* cooperating with cam 38*d* such that wheel 38, which carries hand 16, brings the latter to midday, and nose 464*b* of interlocking lever 464 falls between two columns of wheel 462 via the effect of spring F464*a*, bringing stud 465 between push-button 24 and bent portion 481*c*.

The mechanism is then in state B defined in FIG. 2 and shown in FIG. 4*c*. The connecting member formed by hammer 36 and cam 38*d* then no longer provides the connection between wheel 38 and mobile 34. Switch 46 thus plays the part of control member, and deactivates the connecting member. In this state, push-buttons 24 and 28 are operational. If push-button 28 is pressed again, lever 461*k*, tips and drives pawl 461*p*. This causes column wheel 462 to rotate, which generates the following movements, which occur practically simultaneously or in the following order:

nose 392*b* of retaining lever 392 falls between two columns of wheel 462 via the effect of spring F392, wheel 393 thus being released from toothings 34*c* and 391*d;* nose 502*b* is raised by a column, such that hammer 502 releases cam 38*d;* nose 394*c* falls back between two columns and lever 394 returns to the position shown in FIG. 4*a* via the effect of spring F394;

via the effect of spring F36, hammer 36 tips and abuts against pin 391*e*, which causes isolation mobile 391 to rotate, then against cam 38*d* which drives wheel 38 until hand 16 again displays the minutes of the current time; and nose 464*b* of interlocking lever 464 is raised by a column of wheel 462 such that stud 465 leaves the space comprised between bent portion 481*c* and push-button 24.

The mechanism has thus returned to state A shown in FIG. 4*a*.

From state B, shown in FIG. 4*c*, it is also possible to activate push-button 24, which has the effect of starting a measured time measurement. More specifically, push-button 24 abuts against stud 465, which slides into oblong hole 464*c* and, applied against bent portion 481*c*, causes body 481*a* of lever 481 to pivot. Its pawl 481*d*, more particularly visible in FIG. 5, causes cam 482 to rotate through one step. This movement of cam 482 generates the movements described hereinafter, which occur practically simultaneously or in the following order:

hammer 503, visible in FIG. 5, is raised via its nose 503*a*, such that support surface 503*c* is released from cam 40*c;* the chronograph coupling mechanism causes the coupling wheel to mesh both with the going train and the chronograph second wheel 40, so that the latter is driven in rotation and, with it, chronograph second hand 20;

retaining finger 503*b* releases pin 44*a* from lever 44, such that spring F44 causes lever 44 to pivot, wheel 42*b* being then positioned such that it is in the space swept by finger 41, which can then rotate slide gear 42 and, via the latter, wheel 38 of the minute hand, at a rate of one step per minute, and finger 461*d* is raised by a column of cam 482, which causes body 461*a* (FIG. 4*b*) and lever 461*k* of switching member 461 to tip. Consequently, pin 461*m* is shifted with respect to push-button 28, thus disabling the latter. Moreover, wing 461*f* raises hammer 502 via its pin 502*c*, thus allowing minute hand wheel 38 to rotate.

Moreover, the pivoting of body 461*a* brings its pin 461*h* into groove 501*b* of reset lever 501. During this operation, the connecting member formed by slide gear 42, controlled by control device 48 via hammer 503, passes from the deactivated state to the activated state.

The mechanism is then in the position shown in FIG. 4*d*, which corresponds to state C of FIG. 2. In this state, only push-button 24 is active. In fact, pin 461*m* is shifted with respect to push-button 28, which disables the latter. Moreover, body 461*a*, whose position is defined by finger 461*d* abutting against a column of cam 482, remains in this position, even if groove 501*b* releases pin 461*h*. In other words, an application of pressure on push-button 26 has no effect.

An application of pressure on push-button 24 causes it to abut against stud 465 which slides into oblong hole 464*c* and, applied against bent portion 481*c*, causes lever 481 to pivot. Its pawl 481*d* (FIG. 5) causes cam 482 to rotate through another step. This movement of cam 482 generates the movements described hereinafter, which occur practically simultaneously, or in the following order:

the chronograph coupling mechanism is moved, such that chronograph second wheel 40 is no longer connected to the going train, which means that it stops;

finger 461*d* passes from abutting against a column of cam 482 to a position in which it is between two columns, without, however, body 461*a* and finger 461*d* pivoting, since body 461*a* is retained by pin 461*h* engaged in groove 501*b* of lever 501; and nose 502*a* of hammer 502 is between two columns of wheel 462, but it does not change position, because of pin 502*c* which is abutting against wing 461*f* of body 461*a*.

Hammer 503 is retained by similar means to those retaining hammer 502, but they have not been shown in order to avoid overloading the drawing. The chronograph mechanism is then in state D of the logic diagram of FIG. 2. This state, which is not shown in the drawing, allows action on push-buttons 24 and 26. An application of pressure on push-button 24 starts the time count, the mechanism returning to state C via another rotation of cam 482. Thus, the chronograph coupling mechanism is coupled again, whereas nose 503*a* of the hammer and finger 461*d* are abutting against a column of cam 482.

When the mechanism is in state D, an application of pressure on push-button 26 drives lever 501 which, by pivoting, releases pin 461*h*. Since finger 461*d* is between two columns of cam 482, nothing is holding it any longer, such that spring F461*a* returns switching member 461 to the position shown in FIG. 4*b*. Moreover, hammer 502 is no longer held by wing 461*f*, such that its spring F502 causes it to tip and abut against cam 38*d*, which has the effect of resetting minute hand 16 to zero.

A similar process is applied to hammer 503, such that cam 40*c* is also subjected to a force that returns measured time second hand 20 to midday. The chronograph mechanism is then again in state B defined hereinbefore, such that it is possible to press on push-button 28, to return the mechanism to state A, where push-buttons 24 and 26 are disabled and where minute hand 16 displays the minutes of the current time. It is also possible to press on push-button 24 in order to start a new measurement, the mechanism then being in state C.

Figure 6:
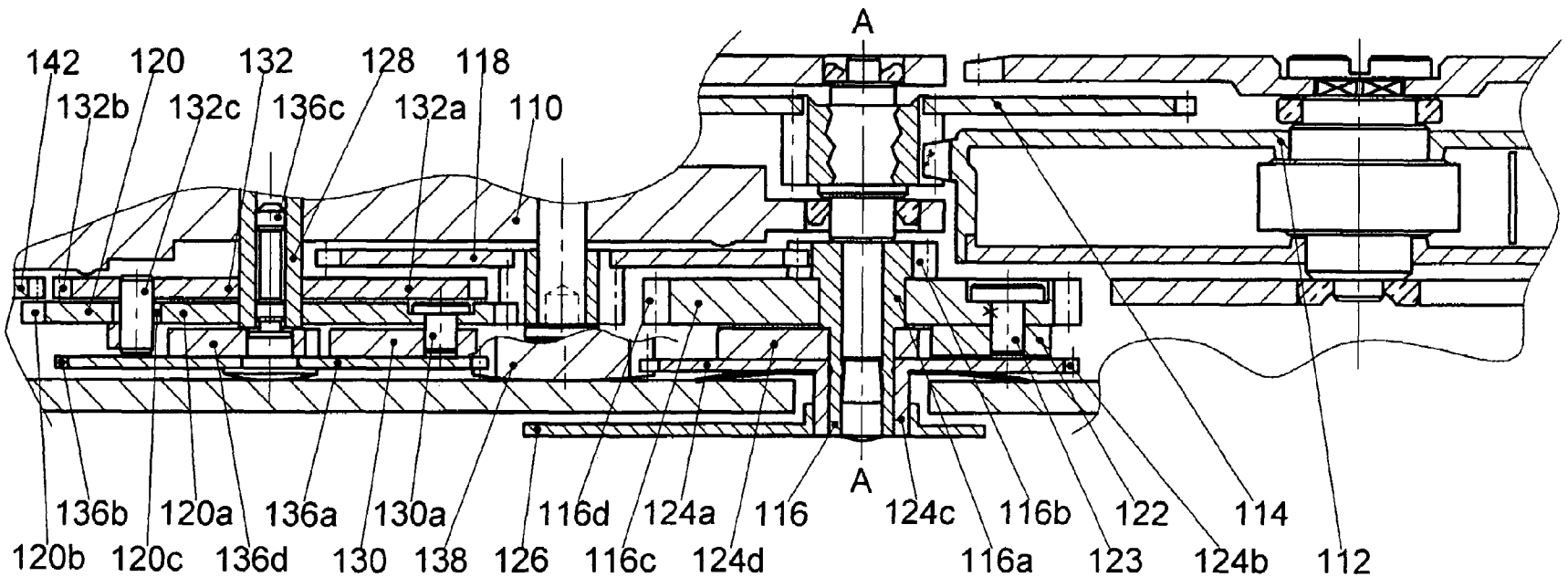
FIGS. 6 and 7 show a part of the watch movement fitted with a display device according to a second embodiment of the invention, comprising only one hand displaying either the hour or the minute, seen in cross-section in FIG. 6 and in plan view in FIG. 7.
Figure 7A:
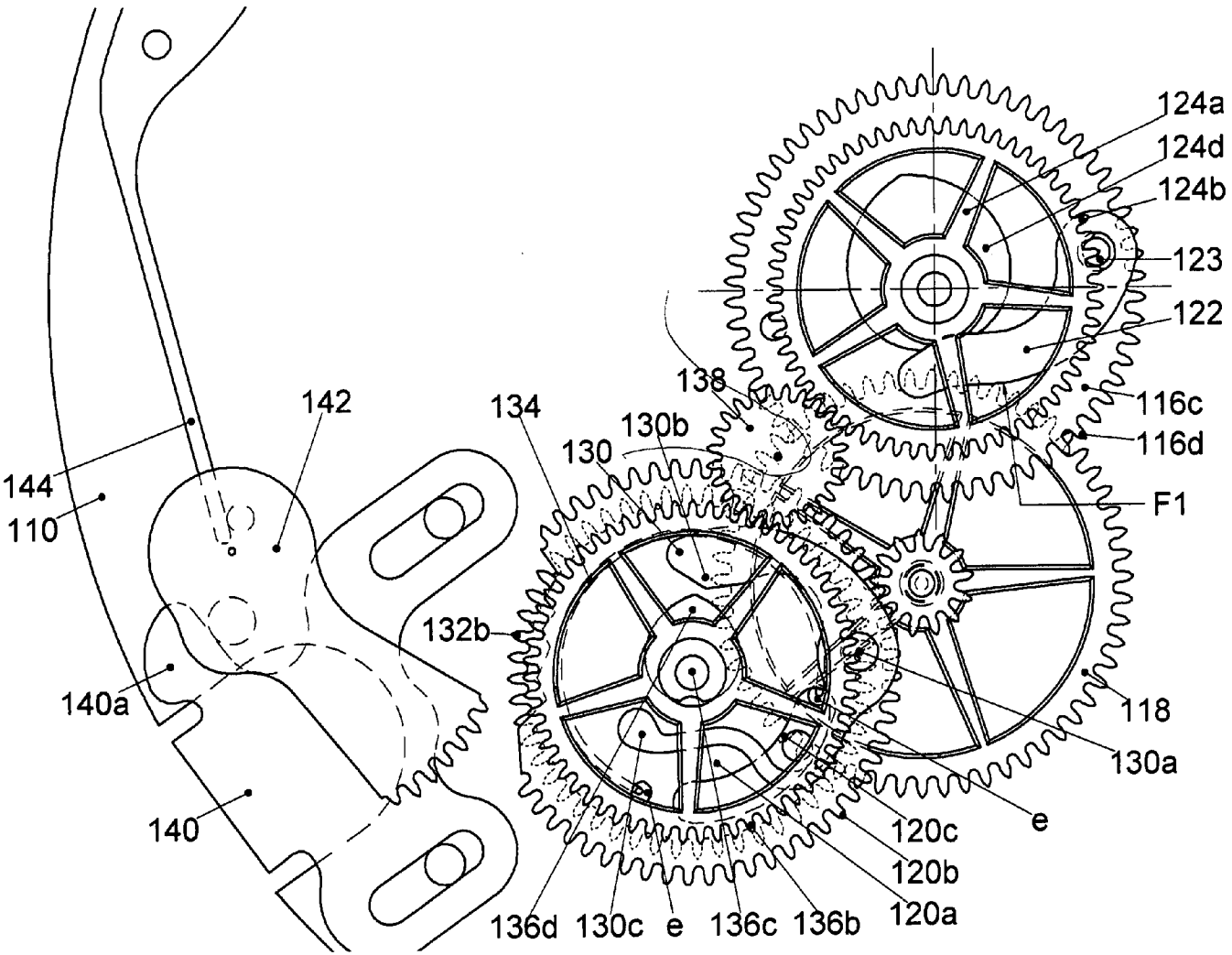
Figure 7B:
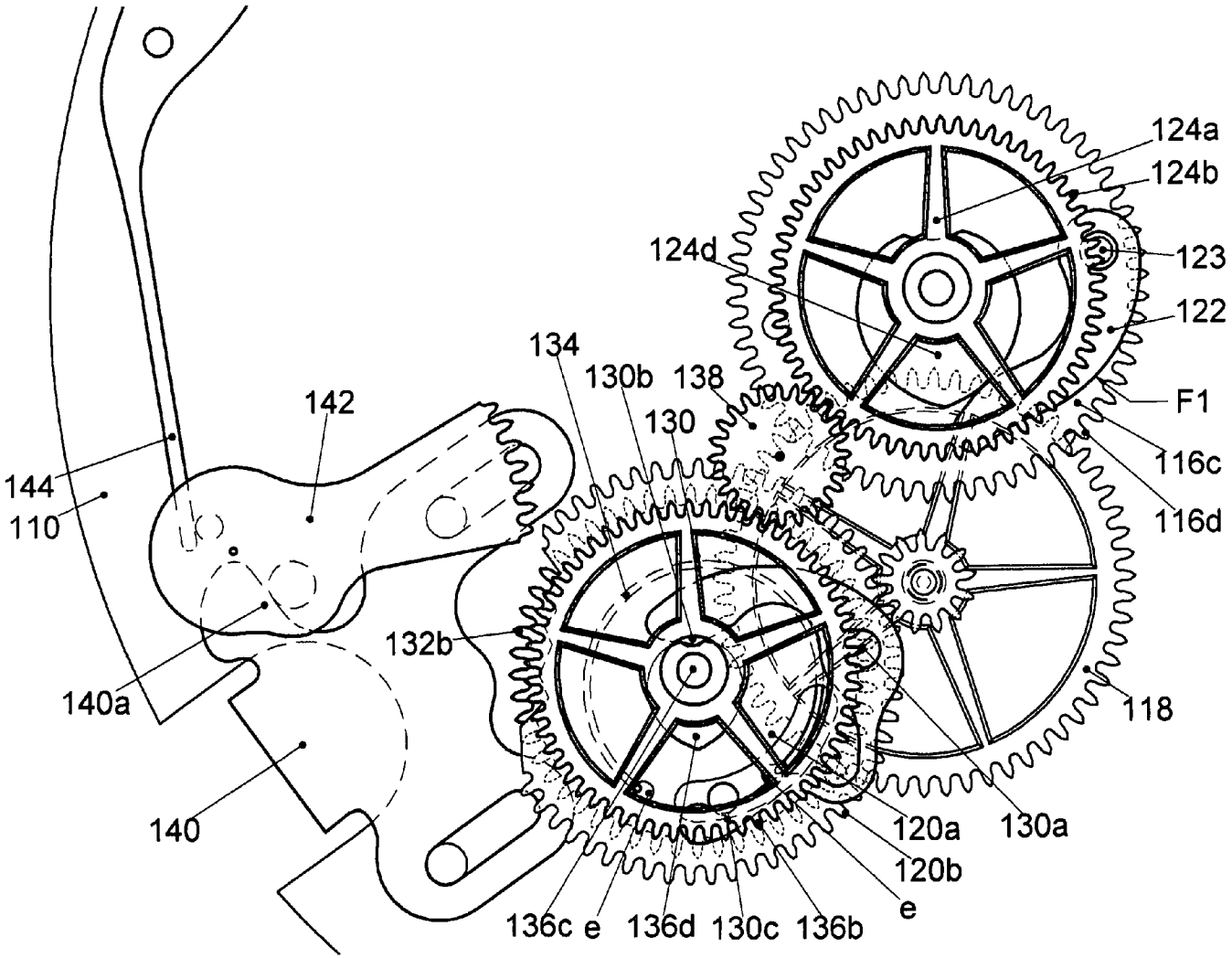

The display device shown in FIGS. 6 and 7 indicates either the minute or the hour. It is shown in the minute display position in FIG. 7*a*, and in the hour display position in FIG. 7*b*. It is designed to be fitted to a watch movement comprising a frame 110, which carries an energy source, in this case a barrel 112, visible in FIG. 6, which drives a going train, whose first mobile is a minute wheel 114. This latter, arranged at the centre of the movement, pivots on frame 110 about an axis A-A and carries a friction mounted cannon-pinion 116 and which meshes with a motion work 118, which drives an hour wheel 120.

Cannon-pinion 116 and hour wheel 120 respectively complete one revolution in sixty minutes and in twelve hours, their angular position defining the state of the information to be displayed. They thus perform the function of information wheels. Moreover, cannon-pinion 116 and motion work wheel 118 and hour wheel 120 play the part usually taken by the motion work in conventional watch movements, the only difference being that none of these mobiles carries a hand.

The cannon-pinion comprises more specifically a tubular portion 116*a*, pierced right through and friction engaged on the centre wheel 114, a pinion 116*b* secured to portion 116*a* and meshing with motion work wheel 118, a wheel plate 116*c*, secured to portion 116*a*, provided with a toothing 116*d* and carrying a hammer 122. This latter is pivotably mounted on a stud 123 driven into plate 116*c*. The hammer is subjected to the action of a spring, schematically represented by an arrow F1 in FIGS. 7*a* and 7*b*, which tends to push hammer 122 back in the direction of axis A-A.

Cannon-pinion 116 carries, free in rotation, a display mobile 124 comprising, rigidly secured to each other, a plate 124*a* provided with a toothing at its periphery, a pipe 124*c* engaged on tubular portion 116*a* and a cam 124*d* inserted between plate 124*a* and plate 116*c*, at the same height as hammer 122. Consequently, via the effect of spring F1, hammer 122 is applied against cam 124*d*. As a result, display mobile 124 is driven in rotation by cannon-pinion 116, via hammer 122 and cam 124*d*, completing one revolution in sixty minutes. This situation is illustrated in FIG. 7*a*.

Pipe 124*c* carries a hand 126, which, in the circumstances described hereinbefore, thus displays the current time minute.

Hour wheel 120 is shifted with respect to the centre of the movement. It includes a plate 120*a* provided with a toothing 120*b* at its periphery, which meshes with the pinion of motion work wheel 118. It is arranged to be free in rotation on a tube 128 driven onto frame 110. It carries a hammer 130 pivotably mounted on a stud 130*a* driven into plate 120*a*. This hammer 130 includes a head 130*b* and a tail 130*c* arranged on either side of the pivoting point, whose function will be described hereinafter. Plate 120*a* has an aperture 120*c* in the form of an annular portion and extending over an angle of approximately 90° (FIGS. 7*a* and 7*b*).

A control wheel 132 is mounted coaxially to hour wheel 120 about tube 128. It comprises a plate 132*a* inserted between wheel 120 and frame 110 and provided, at its periphery, with a toothing 132*b*. A pin 132*c* is driven into the plate, disposed such that it is engaged in aperture 120*c* and projects beyond the latter, extending into the thickness of hammer 130, and arranged for cooperating with tail 130*c*.

Plates 120*a* and 132*a* are each provided with a hole identified by the letter e. A wire spring 134 is inserted between these plates, its ends being engaged in holes 120*e* and 132*e* (FIGS. 7*a* and 7*b*). This spring tends to hold wheels 120 and 134 in a relative position such that pin 132*c* is substantially at one of the ends of aperture 120*c*.

The display device further includes a wheel 136 comprising, rigidly secured to each other, a plate 136*a* provided with a toothing 136*b* at its periphery, an arbour 136*c* rigidly secured to plate 136*a* and pivotably engaged in tube 128, and a cam 136*d*, inserted between plates 136*a* and 132*a*, at the same level as hammer 130. Wheel 136 has the same diameter and the same number of teeth as indication wheel 124 to which it is kinematically connected via an intermediate wheel 138 pivotably mounted on frame 110.

As was explained hereinbefore, hand 126, carried by indication wheel 124, displays the information defined by the angular position of minute wheel 114 when the device is in the position illustrated in FIG. 7*a*.

If, via means that will be described hereinafter, wheel 132 is now rotated with respect to wheel 120, pin 132*c* moves into aperture 120*c*. During this movement, the pin abuts against tail 130*c* of hammer 130 and raises it, such that head 130*c* is pushed against cam 136*d* and exerts pressure that causes the rotation of wheel 136 until it is abutting against the most central part of cam 136*d*. In this position, wheel 136 occupies an angular position corresponding to that of hour wheel 120. Moreover, tail 130*c* is arranged such that pin 132*c* is held in its end position, which corresponds to a notch function.

Since intermediate wheel 138 connects wheel 136 to indication wheel 124, this latter is also driven in rotation. As wheels 124 and 136 have the same number of teeth, they rotate in the same direction and at the same speed as hour wheel 120. Cannon-pinion 116 is not involved in this movement. Hammer 122 is thus raised. In other words, the movement of wheel 132 with reference to hour wheel 120 causes the display to pass from indicating the minutes to indicating the hours.

In order to move wheel 132, the device according to the invention further comprises, a control mechanism 140 mounted so as to slide on frame 110, a rack 142 arranged in proximity, at the same level as wheel 132, and controlled by a finger 140*a* comprised in control mechanism 140 and a spring 144 cooperating with rack 142 to hold it, in the rest position, in the position shown in FIG. 7*a*. A push-button that is not shown in the drawing, mounted so as to slide in the watchcase, cooperates with control mechanism 140 and pushes it in the direction of axis A-A. Finger 140*a* tips rack 142, which drives with it wheel 132, which controls the hour display, by the process that has been described.

As soon as the push-button is released, spring 144 returns rack 142 to its start position which, by this movement, causes wheel 132 to rotate in the opposite direction. Consequently, pin 132*c* no longer holds tail 130*c* of hammer 130. Spring 134 participates in this movement and repositions wheel 132 in a position relative to wheel 120 corresponding to that shown in FIG. 7*a*, hand 126 thus again displaying the minutes.

What is claimed is:

1. A display device for a watch movement of the type comprising:

a frame;

a set of wheels pivotably mounted on said frame and including a first information wheel and a second information wheel, wherein an angular position of said first information wheel is a function of a state of a first piece of information to be displayed and an angular position of said second information wheel is a function of a state of a second piece of information to be displayed with said first piece of information being different from said second piece of information and said angular position of said first piece of information not being dependant on said angular position of said second piece of information;

a display member having an axis and being mounted for rotation about said axis;

a display wheel mounted on said frame about said axis and arranged for carrying said display member;

connecting members for kinematically connecting said display wheel to one or other of said first and second wheels; and activating means cooperating with said connecting members and arranged to allow the connection of said display wheel to be switched from one of said first and second wheels to the other of said first and second wheels.

2. A device according to claim 1, wherein the first wheel is coaxial with said display wheel and wherein said connecting means includes a cam securely fixed to said display wheel in rotation and a first hammer disposed on the first wheel facing said cam and provided with an elastic member arranged to hold said first hammer abutting against the cam, such that said first wheel can drive said display wheel in rotation via the action of the hammer on the cam.

3. A device according to claim 2, wherein said control means includes a control mechanism and a switching mechanism enabling or disabling the control mechanism and cooperating with the first hammer such that said first hammer is removed from the cam when said control mechanism is activated.

4. A device according to claim 3, wherein said control mechanism is of a chronograph type.

5. A device according to claim 2, wherein said second wheel is pivotably mounted about an axis substantially parallel to the axis of the display wheel and wherein the connecting means further comprises:

a connecting wheel disposed coaxially with the second wheel and kinematically connected to said display wheel, a second hammer and a second cam one disposed on the connecting wheel and the other on the second wheel, and wherein the drive means includes a coupling-disconnecting member arranged for applying or not applying the second hammer against the second cam such that, when it is applied, the torque generated on the display wheel by the connecting wheel is greater than that exerted by the first hammer on the first cam.

6. A device according to claim 5, wherein an intermediate wheel is disposed between the connecting wheel and the display wheel such that said display wheel rotates in the same direction as the second wheel, when said display wheel and said second wheel are kinematically connected to each other.

7. A device according to claim 1, wherein said activating means is of the mono-stable type and is arranged such that, during activation, the connecting means connects said display wheel to one of said wheels and when the activation is interrupted, the connecting means connects the display wheel to the other wheel.

8. A device according to claim 1, wherein said activating means is of a bi-stable type and is arranged such that, during a first activation, the connecting means connects said display wheel to one of said first wheel and second wheel and during a second activation, the connecting means connects the display wheel to the other of said first wheel and second wheel.

9. A display device for a watch movement, the display device comprising:

a frame;

a first information wheel mounted for rotational movement on said frame, an angular position of said first information wheel being a function of a state of a current time connection to a going train to be set for a current time;

a second information wheel mounted for rotational movement on said frame, an angular position of said second information wheel being a function a connection to a going train with the angular position being based on one of a reset and stop of a chronograph device connected between said going train and said second information wheel and a time elapsed following start of the chronograph device;

a display member having an axis and being mounted for rotation about said axis;

a display wheel mounted on said frame about said axis and arranged for carrying said display member;

connecting members for kinematically connecting said display wheel to one of said first wheel and said second wheel; and activating means cooperating with said connecting members and arranged to allow the connection of said display wheel to be switched between said first wheel and said second wheel.

10. A device according to claim 9, wherein said first wheel is coaxial with said display wheel and wherein said connecting means includes a cam securely fixed to said display wheel in rotation and a first hammer disposed on said first wheel facing said cam and provided with an elastic member arranged to hold said first hammer abutting against said cam, such that said first wheel can drive said display wheel in rotation via the action of the hammer on the cam.

11. A device according to claim 10, wherein said control means includes a control mechanism and a switching mechanism enabling or disabling the control mechanism and cooperating with the first hammer such that said first hammer is removed from the cam when said control mechanism is activated.

12. A device according to claim 11, wherein said control mechanism comprises a chronograph mechanism.

13. A device according to claim 10, wherein said second wheel is pivotably mounted about an axis substantially parallel to said axis of said display wheel and wherein the connecting means further comprises:

a connecting wheel disposed coaxially with said second wheel and kinematically connected to said display wheel, a second hammer and a second cam, one of said second hammer and said second cam being disposed on the connecting wheel and the other of said second hammer and said second cam being disposed on the second wheel, and wherein said drive means includes a coupling-disconnecting member arranged for applying or not applying said second hammer against said second cam such that, when applied, the torque generated on said display wheel by said connecting wheel is greater than that exerted by said first hammer on said first cam.

14. A device according to claim 13, wherein an intermediate wheel is disposed between said connecting wheel and said display wheel such that said display wheel rotates in the same direction as said second wheel, when said display wheel and said second wheel are kinematically connected to each other.

15. A device according to claim 9, wherein said activating means is of the mono-stable type and arranged such that, during activation, the connecting means connects said mobile to one of said wheels and when the activation is interrupted, the connecting means connects the mobile to the other wheel.

16. A device according to claim 9, wherein said activating means is of a bi-stable type and is arranged such that, during a first activation, the connecting means connects said display wheel to one of said first wheel and second wheel and during a second activation, the connecting means connects the display wheel to the other of said first wheel and second wheel.

* * * * *